US006186879B1

(12) United States Patent
Ericsson

(10) Patent No.: US 6,186,879 B1
(45) Date of Patent: Feb. 13, 2001

(54) ROTARY POWER TOOL WITH AN EXTENDED OUTPUT SHAFT

(75) Inventor: Per Erik Ericsson, Ekerö (SE)

(73) Assignee: Atlas Copco Tools AB, Nacka (SE)

( * ) Notice: Under 35 U.S.C. 154(b), the term of this patent shall be extended for 0 days.

(21) Appl. No.: 09/380,880

(22) PCT Filed: Mar. 10, 1998

(86) PCT No.: PCT/SE98/00439

§ 371 Date: Nov. 18, 1999

§ 102(e) Date: Nov. 18, 1999

(87) PCT Pub. No.: WO98/40190

PCT Pub. Date: Sep. 17, 1998

(30) Foreign Application Priority Data

Mar. 10, 1997 (SE) ..... 9700842

(51) Int. Cl.[7] ..... B24B 23/00; B24B 27/08

(52) U.S. Cl. ..... 451/358; 451/360; 451/344

(58) Field of Search ..... 451/358, 360, 451/177, 178, 344

(56) References Cited

U.S. PATENT DOCUMENTS

| | | | | |
|---|---|---|---|---|
| 1,697,046 | * | 1/1929 | Chapman et al. | 451/360 |
| 2,097,944 | * | 11/1937 | Casey | 451/358 |
| 2,099,280 | * | 11/1937 | Shaff | 451/358 |
| 2,112,695 | * | 3/1938 | Forss | 451/358 |
| 2,342,610 | * | 2/1944 | Elliot | 451/358 |
| 2,451,658 | * | 10/1948 | Bugatti | 451/360 |
| 2,582,873 | * | 1/1952 | Larson et al. | 451/360 |
| 3,410,030 | | 11/1968 | McHenry . | |
| 3,591,989 | | 7/1971 | Granlie . | |

FOREIGN PATENT DOCUMENTS

| | | | | |
|---|---|---|---|---|
| 236816 | * | 7/1945 | (CH) | 451/360 |
| 37018 | | 9/1930 | (FR) . | |
| 591661 | | 8/1947 | (GB) . | |
| 658278 | | 10/1951 | (GB) . | |
| 122820 | * | 9/1948 | (SE) | 451/360 |

* cited by examiner

*Primary Examiner*—Derris H. Banks
(74) *Attorney, Agent, or Firm*—Frishauf, Holtz, Goodman, Langer & Chick, P.C.

(57) ABSTRACT

A rotary power tool having a housing (10) with a tubular extension (12), a rotation motor located in the housing, and an output shaft (13), wherein the output shaft (13) comprises a first section (23), a second section (26) and a connection device (30) forming a drive connection between the shaft sections without any radial play but with a flexibility to angle deviations between the shaft sections (23, 26), the connection device (30) including a sleeve element (31) with a conical socket portion (32) for mounting on a conical surface (33) on the first shaft section (23), a recess (34) of rectangular cross section for torque transfer to a matching rectangular projection (35) on the second shaft section (26), and a ball bearing (43) mounted between a cylindrical socket portion (42) on the sleeve element (31) and a cylindrical end portion (36) of the second shaft section (26) for providing an accurate radial guidance and support of the rear end portion (36) of the second shaft section (26) relative to the sleeve element (31) under a certain flexibility to angle deviations between the two shaft sections (23, 26).

8 Claims, 4 Drawing Sheets

ROTARY POWER TOOL WITH AN EXTENDED OUTPUT SHAFT

This invention relates to a rotary power tool of the type having a housing with a tubular extension, a rotation motor located in the housing, and an output shaft drivingly connected to the motor.

In particular, the invention concerns a rotary power tool of the above type in which the output shaft comprises a first section journalled in the housing by means of two axially spaced bearings, a second section journalled in the tubular extension by a single bearing only located at the outer end of the tubular extension, and a connection device for drivingly interconnecting the first and second shaft sections.

Previous tools of this type are described in U.S. Pat. Nos. 3,410,030 and 3,591,989.

In the power tool shown in U.S. Pat. No. 3,410,030, FIG. 8, the output end of the motor is drivingly connected to an extended output shaft via a spline coupling. Apart from being rather expensive to manufacture, this type of splined connection is not able to provide an accurate enough radial support for the inner end of the output shaft. Thereby, there is a risk for an untrue rotation of the latter and, accordingly, vibrations to be caused at high speed operation.

As mentioned above, one problem inherent in the shaft connections of many prior art power tools of this type is a poor radial support of the inner end of the output shaft extension. Another problem, however, comes up when trying to accomplish a shaft connection which is almost free of radial play, namely how to provide a certain flexibility as regards angle deviations between the shaft sections. Accordingly, it is difficult to obtain a shaft coupling which provides at the same time a playfree radial support and a certain flexibility to angle faults occurring between the two shaft sections. In practice, such faults are inevitable due to tolerance scattering at manufacturing of the tool parts, and to avoid built-in strains in the shaft sections, the bearings and the shaft connection a certain flexibility to angle deviations has to be provided.

A primary object of the invention is to provide a rotary power tool with a shaft connection device which combines an accurate radial support and guidance of the interconnected parts with a certain flexibility to angle faults between the shaft sections.

Other objects and advantages of the invention will appear from the following detailed specification.

A preferred embodiment of the invention is below described in detail with reference to the accompanying drawings.

On the drawings

Figure 1:
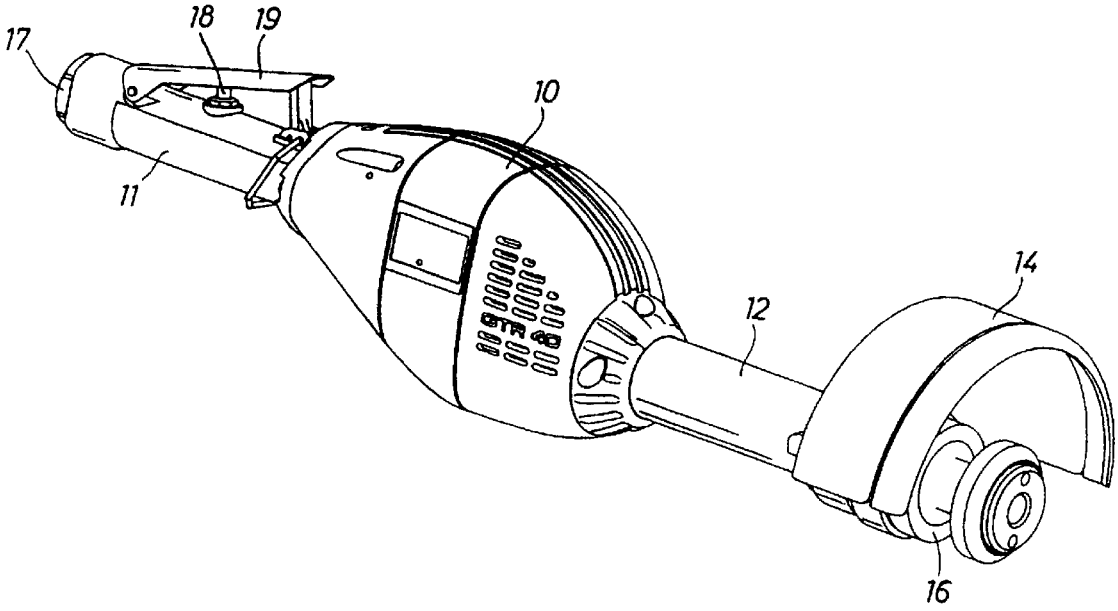
FIG. 1 shows a perspective view of a rotary tool according to the invention.

The power tool illustrated in the drawing figures is a so called straight grinder which includes a central housing 10 with a rotation motor (not shown) and provided with a handle 11 at its rear end and a tubular extension 12 for rotationally supporting an output shaft 13 at its forward end. At its forward end, the housing extension 12 carries a grinding wheel safe guard 14. The outer end of the output shaft 13 is provided with a threaded portion 15 for carrying a grinding wheel mounting means 16. See FIG. 1.

The described tool comprises a turbine type pneumatic motor to which motive pressure air is supplied via a conduit connection 17 and a throttle valve 18 in the handle 11. The throttle valve 18 is controlled by a lever 19.

Figure 2:
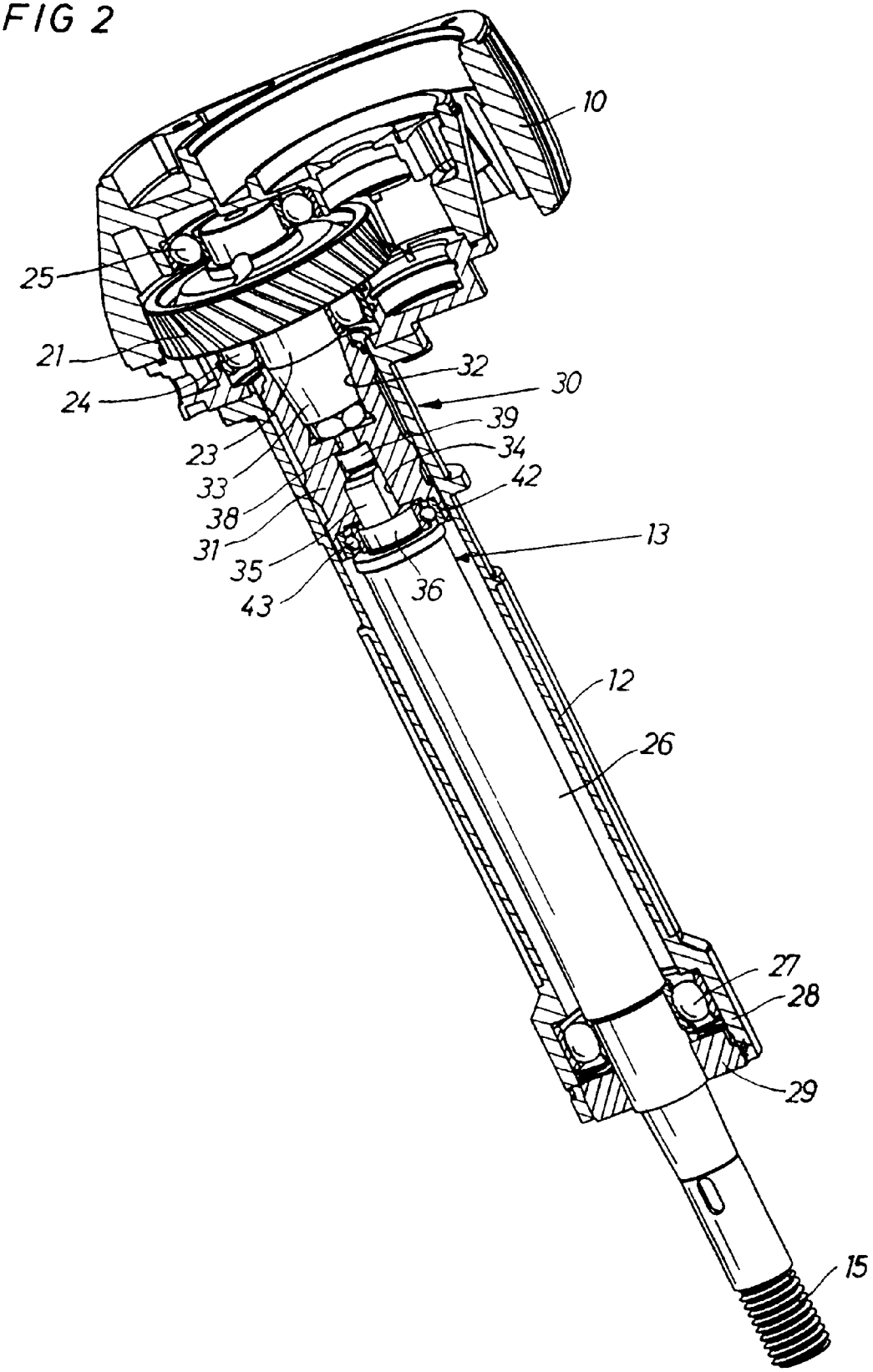
FIG. 2 shows a perspective view, partly in section, of the output end of the tool in FIG. 1.
Figure 3:
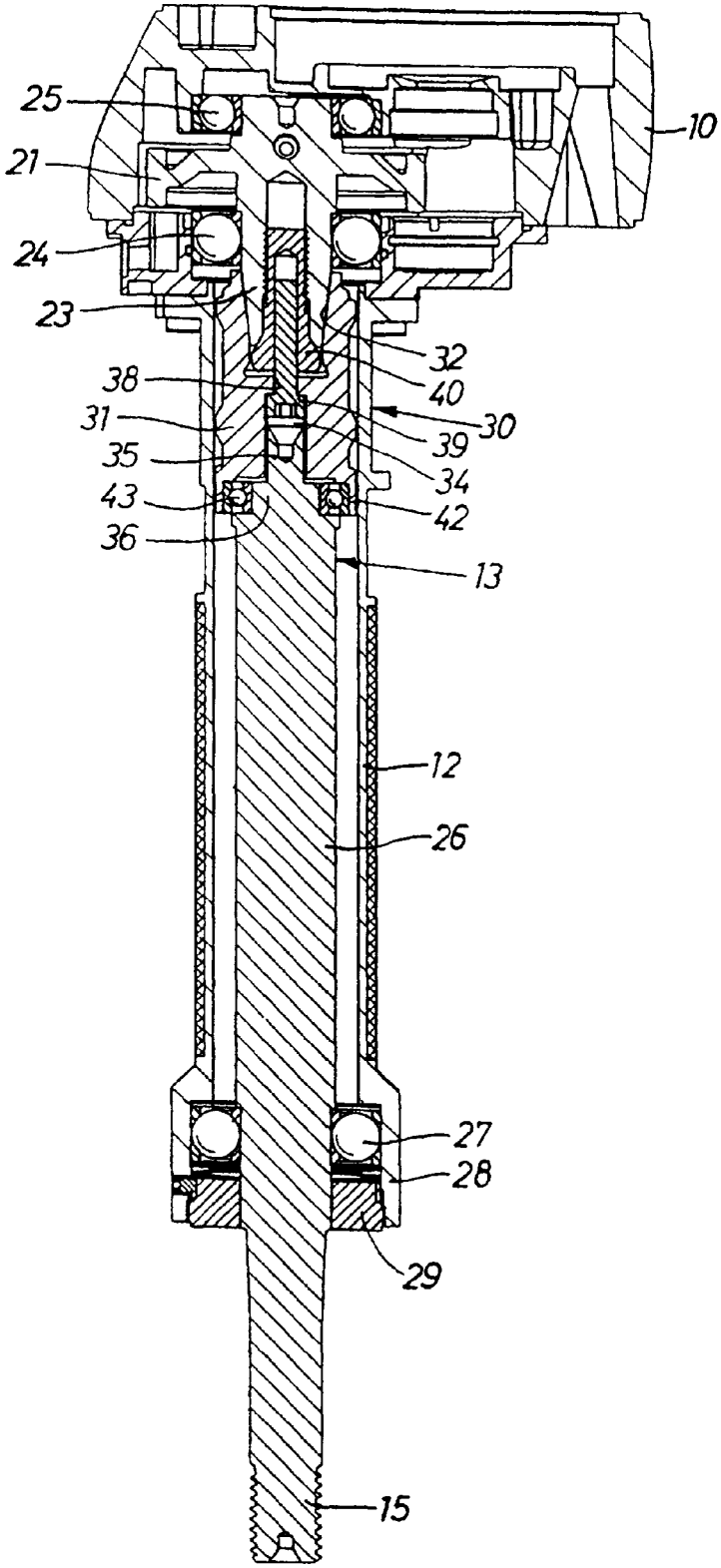
FIG. 3 shows a longitudinal section through the output end of the tool in FIG. 1.
Figure 4:
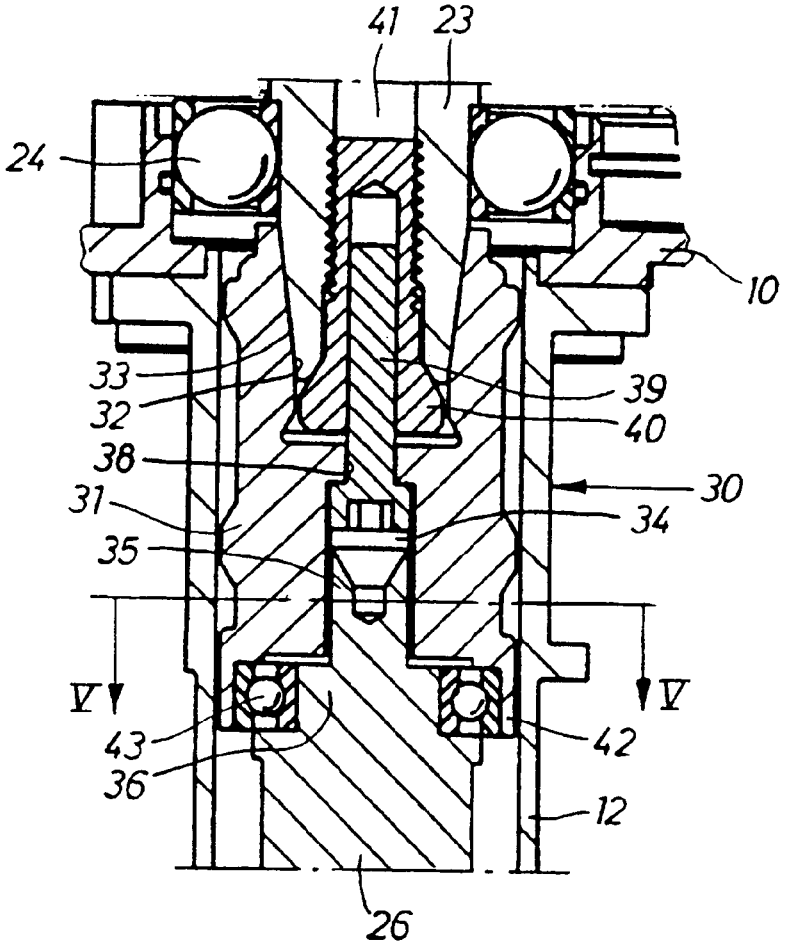
FIG. 4 shows, on a larger scale, a detail view of the shaft connection device.

As illustrated in FIGS. 2 and 3, the output shaft 13 is provided with a gear wheel 21 which is a part of a reduction gearing disposed in the housing 10 and which connects the motor to the output shaft 13. The purpose of this gearing is to reduce the very high operation speed of the turbine motor to a speed suitable for grinding wheel operation. Since the motor and the reduction gearing are not parts of the invention they are not described in further detail.

The output shaft 13 comprises a first section 23 which carries the gear wheel 21 and which is journalled in the housing 10 in two bearings 24, 25. The output shaft 13 further comprises a second section 26 which is journalled in a single ball bearing 27 mounted in a socket portion 28 at the outer end of the tubular housing extension 12. The tubular housing extension 12 is terminated by a ring element 29 which is threaded into the outer end of the socket portion 28 to form an axial support for the bearing 27. At its rear end, the second output shaft section 26 is joined with the first shaft section 23 by means of a connection device 30.

Figure 5:
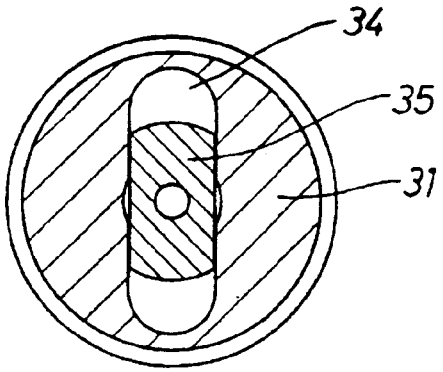
FIG. 5 shows a cross section along line V—V in FIG. 4 illustrating the torque transferring coupling.

The connection device 30 comprises a sleeve element 31 which at its rear end is formed with a conical socket portion 32 for interengagement with a conical surface 33 on the first shaft section 23 for securing the sleeve element 31 to the latter. At its forward end, the sleeve element 31 is formed with a central recess 34 of rectangular cross section for cooperation with a central projection 35 of a matching rectangular shape protruding from a cylindrical rear end portion 36 of the second shaft section 26, thereby forming a torque transferring coupling device between the two shaft sections 23, 26. See FIG. 5.

The sleeve element 31 has a coaxial bore 38 extending between the recess 34 and the conical socket portion 32, and a mounting screw 39 extends through the bore 38 and engages an insertion member 40 which is threaded into a coaxial bore 41 in the first shaft section 23. The mounting screw 39 applies an axial pretension force on the sleeve element 31 to rigidly secure the latter to the first shaft section 23.

At its forward end, the sleeve element 31 comprises a cylindrical socket portion 42 in which is mounted the outer race of a single-row ball bearing 43. The inner race of the bearing 43 is mounted on the cylindrical end portion 36 of the second shaft section 26, whereby the bearing 43 forms a radial support and guide means with a very small radial play between the two shaft sections 23, 26.

An important characteristic of the ball bearing guide is the ability to allow a certain flexibility to angle deviations between the two shaft sections 23, 26 without any radial play. This is an important characteristic of the shaft connection, because the second shaft section 26 is journalled in one bearing only and has to be accurately supported radially not to cause vibrations due to an untrue rotation at its inner end. Since both of the ball bearings 43 and 27 are of the single-row type, there is allowed a certain angle deviation between the shaft sections 23, 26, and there will be no built-in bending stresses in the bearings 43, 27, the shaft sections 23, 26 and the connection device 30.

It should be noted that the embodiments of the invention are not limited to the described example but can be freely varied within the scope of the claims. Accordingly, the described power tool is of the type having a high speed motor and a reduction gearing, but the invention is as well applicable on a tool having a low speed motor and lacking a reduction gearing. In such a tool, the motor shaft forms the first output shaft section, i.e. the connection sleeve element 31 is mounted directly on the motor shaft.

What is claimed is:

1. Rotary power tool including a housing (10) with a tubular extension (12), a rotation motor, and an output shaft (13) which is connected to said motor and which comprises a first section (23) journalled in said housing (10) by means of two axially spaced bearings (24, 25), a second section (26) journalled in said tubular extension (12) by means of a single bearing (27) located at the outer end of said tubular extension (12), and a connection device (30) drivingly interconnecting said first shaft section (23) and said second shaft section (26), characterized in that said connection device (30) comprises a sleeve element (31) which on one hand is rigidly secured to either one of said first shaft section (23) and said second shaft section (26) and which on the other hand is arranged to receive an end portion (36) of the other one of said first shaft section (23) and said second shaft section (26), a coupling means (34, 35) for transferring torque between said sleeve element (31) and said end portion (36), and a ball bearing (43) located between said sleeve element (31) and said end portion (36) and arranged to form a support means for accurate radial guidance of said end portion (36) relative to said sleeve element (31).

2. Power tool according to claim 1, wherein said coupling means (34, 35) comprises a central projection (35) of substantially rectangular cross section protruding axially from said end portion (36) and a central recess (34) of substantially rectangular cross section in said sleeve element (31), matching said projection (35).

3. Power tool according to claim 2, wherein said sleeve element (31) is rigidly secured to said first shaft section (23) by interengagement of a conical socket (32) in said sleeve element (31) and a conical surface (33) on said first shaft section (23), and said end portion (36) is formed on said second shaft section (26).

4. Power tool according to claim 3, wherein said first shaft section (23) is connected to the rotor of the rotation motor via a reduction gearing.

5. Power tool according to claim 2, wherein said first shaft section (23) is connected to the rotor of the rotation motor via a reduction gearing.

6. Power tool according to claim 1, wherein said sleeve element (31) is rigidly secured to said first shaft section (23) by interengagement of a conical socket (32) in said sleeve element (31) and a conical surface (33) on said first shaft section (23), and said end portion (36) is formed on said second shaft section (26).

7. Power tool according to claim 6, wherein said first shaft section (23) is connected to the rotor of the rotation motor via a reduction gearing.

8. Power tool according to claim 1, wherein said first shaft section (23) is connected to the rotor of the rotation motor via a reduction gearing.

* * * * *